US007841475B2

(12) United States Patent
Ricardo et al.

(10) Patent No.: US 7,841,475 B2
(45) Date of Patent: Nov. 30, 2010

(54) CONTINUOUSLY OPERATING MACHINE HAVING MAGNETS

(75) Inventors: Rodolfo Ricardo, Yonkers, NY (US); Savas Ozkan, Ramsey, NJ (US)

(73) Assignee: Kalustyan Corporation, Union, NJ (US)

( * ) Notice: Subject to any disclaimer, the term of this patent is extended or adjusted under 35 U.S.C. 154(b) by 394 days.

(21) Appl. No.: 11/893,376

(22) Filed: Aug. 15, 2007

(65) Prior Publication Data

US 2009/0045104 A1 Feb. 19, 2009

(51) Int. Cl.
*B03C 1/00* (2006.01)

(52) U.S. Cl. ..... 209/229; 209/223.2; 209/225; 209/231; 209/232; 210/695; 210/222; 210/340

(58) Field of Classification Search ..... 209/213–232; 210/695, 222, 223, 739, 253, 254, 340, 341
See application file for complete search history.

(56) References Cited

U.S. PATENT DOCUMENTS

| | | | | |
|---|---|---|---|---|
| 1,837,299 | A | | 12/1931 | Taggart |
| 2,074,085 | A | | 3/1937 | Frantz |
| 2,331,102 | A | | 10/1943 | Bird |
| 2,373,635 | A | | 4/1945 | Wuensch |
| 2,496,590 | A | | 2/1950 | Marsh |
| 2,696,301 | A | | 12/1954 | Mojden |
| 2,736,432 | A | | 2/1956 | Gardes |
| 2,901,108 | A | | 8/1959 | Spodig |
| 2,964,184 | A | | 12/1960 | Gillette |
| 2,968,402 | A | | 1/1961 | Spodig |
| 2,988,212 | A | | 6/1961 | Walker |
| 3,037,711 | A | | 6/1962 | Businger |
| 3,049,234 | A | | 8/1962 | Laurila |
| 3,693,792 | A | | 9/1972 | Lang |
| 3,745,995 | A | | 7/1973 | Kraus |
| 3,902,994 | A | | 9/1975 | Maxwell et al. |
| 4,266,982 | A | * | 5/1981 | Bender et al. ..... 134/18 |
| 4,457,838 | A | * | 7/1984 | Carr ..... 209/223.2 |
| 4,533,053 | A | | 8/1985 | Kenny et al. |
| 4,755,302 | A | * | 7/1988 | Unkelbach et al. ..... 210/695 |
| 4,867,869 | A | * | 9/1989 | Barrett ..... 209/223.2 |
| 4,874,507 | A | | 10/1989 | Whitlock |
| 4,880,206 | A | | 11/1989 | Lungu et al. |
| 5,004,539 | A | | 4/1991 | Colwell, Jr. |

(Continued)

FOREIGN PATENT DOCUMENTS

JP 4-311539 * 11/1992

*Primary Examiner*—Richard W Ridley
*Assistant Examiner*—Jeremy Severson
(74) *Attorney, Agent, or Firm*—Lerner, David, Littenberg, Krumholz & Mentlik, LLP

(57) ABSTRACT

A continuously operating magnetic particle separating machine includes an inlet for receiving a material having magnetic particles mixed therein, an outlet for discharging the material after the magnetic particles have been separated therefrom, a first flow path extending between the inlet and the outlet, a first magnetic element positionable in the first flow path, a second flow path extending between the inlet and the outlet, and a second magnetic element positionable in the second flow path. The separating machine includes a control system including a diverter valve switchable between a first position for directing the material through the first flow path and a second position for directing the material through the second flow path, whereby the switching frequency of the diverter valve is responsive to a concentration of the magnetic particles in the material.

18 Claims, 5 Drawing Sheets

U.S. PATENT DOCUMENTS 5,066,390 A * 11/1991 Rhodes et al. ..... 209/217
5,076,914 A * 12/1991 Garaschenko et al. ..... 210/186
5,170,891 A 12/1992 Barrett
5,188,239 A * 2/1993 Stowe ..... 209/223.1
5,190,159 A * 3/1993 Barker ..... 209/223.2
5,348,160 A 9/1994 Kindig
5,370,234 A 12/1994 Sommer, Jr. et al.
5,383,491 A * 1/1995 Heilman ..... 137/597
5,520,288 A 5/1996 Drenter et al.
5,638,959 A 6/1997 Sommer, Jr. et al.
5,830,282 A 11/1998 Olashuk
5,860,532 A 1/1999 Arvidson
6,000,417 A 12/1999 Jacobs
6,015,487 A 1/2000 Mori et al.
6,120,502 A 9/2000 Michelson
6,129,216 A 10/2000 Vandewinckel et al.
6,187,259 B1 2/2001 Yamashita et al.
6,190,563 B1 2/2001 Bambic
6,210,572 B1 4/2001 Tulchinskiy
6,250,475 B1 * 6/2001 Kwasniewicz et al. ..... 209/229
6,468,810 B1 10/2002 Korpela et al.
6,605,089 B1 8/2003 Michelson
6,610,092 B2 8/2003 Ralph et al.
6,723,938 B1 4/2004 Gates et al.
6,778,861 B1 8/2004 Liebrecht et al.
6,833,069 B1 * 12/2004 Asterlin ..... 210/222
6,902,066 B2 * 6/2005 Yang ..... 209/223.1
6,902,623 B2 6/2005 Gurary et al.
6,918,934 B2 7/2005 Ralph et al.
6,994,219 B2 2/2006 Roth et al.
7,073,668 B2 * 7/2006 Alford et al. ..... 209/216
2002/0108890 A1 8/2002 Abrarov et al.
2003/0032801 A1 2/2003 Lin et al.
2003/0159976 A1 * 8/2003 Iwasaki ..... 209/232
2004/0035760 A1 2/2004 Alford et al.
2006/0011552 A1 1/2006 Utsunomiya
2006/0016732 A1 * 1/2006 Franzreb et al. ..... 209/232
2006/0096894 A1 5/2006 Brandner et al.
2006/0108271 A1 5/2006 Phillip et al.
2007/0010702 A1 1/2007 Wang et al.
2007/0023326 A1 2/2007 Armstrong et al.
2007/0090055 A1 4/2007 Newman et al.

* cited by examiner

CONTINUOUSLY OPERATING MACHINE HAVING MAGNETS

FIELD OF THE INVENTION

The present invention is directed to separating and/or filtering machines and is more particularly directed to metallic particle separating machines.

BACKGROUND OF THE INVENTION

Metallic particles are often present in materials such as spices, flour, sugar, chemicals and pharmaceutical ingredients. Before the materials may be further processed, the metallic particles must be removed. In many instances, magnetic forces or magnets may be used for removing the metallic particles from the material. The dry material, with the metallic particles removed, may then be further processed.

There have been a number of advances in metallic particle separating machines. For example, U.S. Pat. No. 4,457,838 to Carr discloses a self-cleaning magnetic separator for powered plastic and metal materials. The magnetic separator includes an inlet, a base plate and side plates. A plurality of vertically spaced staggered rows of laterally spaced pilot tubes are secured to the side plates to define a circuitous material falling path. An upright tube clearance plate is arranged intermediate the side plates and has a corresponding plurality of vertically spaced rows of laterally spaced apertures, oversized with respect to and loosely receiving the tubes defining clearance apertures. The clearance plate defines on one side an upright plastic feed chamber having an outlet in the base plate. An upright wiper plate is arranged between the clearance plate and one side plate having a corresponding series of apertures snugly receiving the tubes and defining with the adjacent side plate an upright metal feed chamber having an outlet. The elongated magnetic assembly is slidably mounted upon and intermittently reciprocal within each tube and is normally positioned within the plastic feed chamber. Falling particles of plastic cascade over the tubes within the plastic feed chamber for delivery through its outlet, however, the metal particles mixed in with the plastic particles adhere to the tubes. Upon intermittent retraction of the magnetic assemblies, the wiper plates strip the metal particles from the tubes and the metal particles fall within the metal feed chamber and through its outlet.

U.S. Pat. No. 4,867,869 to Barrett discloses a grate magnet apparatus including a frame having an opening adapted to have material pass therethrough. The apparatus includes a non-magnetic tube supported by the frame and extending across the opening, and an elongated magnetic member removably housed in the tube. Magnetic material is attracted to the tube when the magnetic member is housed in the tube. The magnetic material is released from the tube when the magnetic member is removed from the tube. The non-magnetic tubes and magnet members are connected both for joint movement to be withdrawn from the path of the flowing material and then for relative movement to release magnetic material from the non-magnetic tube.

U.S. Pat. No. 5,066,390 to Rhodes et al. discloses a magnetic separator with a reciprocal grate. The magnetic separator includes a plurality of elongated magnetic members that are parallel with one another. A first end plate is connected to adjacent terminal ends of the magnetic members to hold the magnetic members with the longitudinal axes generally defining a common plane. Non-magnetic sheathing members are disposed sheathing the entire longitudinal length of the magnetic members. A second end plate is connected to adjacent terminal ends of the non-magnetic members to provide longitudinal sheathing and unsheathing movement of the sheathing members with respect to the magnetic members for cleaning accumulated magnetic particles from the exterior surface of the non-magnetic members. The first and second end plates are adapted for reciprocating movement in the common plane, preferably in a direction generally perpendicular to the longitudinal axes of the magnetic members to reduce bridging and clogging of the material flow.

U.S. Pat. No. 5,188,239 to Stowe, U.S. Pat. No. 5,190,159 to Barker, U.S. Pat. No. 6,250,475 to Kwasniewicz et al., and U.S. Pat. No. 6,902,066 to Yang disclose other metallic particle separating machines that have magnetic tubes that are retracted for wiping or cleaning accumulated metallic particles from the tubes.

In spite of the above advances, there remains a need for a metallic particle separating machine that may be cleaned in a more efficient and efficacious manner. There also remains a need for a magnetic particle separating machine that may be continuously operated, and that does not have to be shut down or stopped in order to clean the internal components of the machine. There also remains a need for a metallic particle separating machine that efficiently collects magnetic particles for disposal.

These and other preferred embodiments of the present invention will be described in more detail below.

SUMMARY OF THE INVENTION

The present invention generally relates to a separating machine that removes metallic and/or magnetic particles from materials, such as spices, chemicals, powders, dry bulk goods, and pharmaceutical ingredients. The separating machine desirably includes an upper end having an inlet and a lower end having an outlet. The machine includes a first flow path extending between the inlet and the outlet and a second flow path also extending between the inlet and the outlet. The first and second flow paths define separate and distinct paths or conduits that extend between the inlet and the outlet. The separating machine also includes a diverter valve having a flap extending therefrom at the inlet that directs the material through either the first flow path or the second flow path. In a first position, the flap of the diverter valve directs the material through the first flow path. In a second position, the flap of the diverter valve directs the material through the second flow path. The first flow path includes a first array of magnets that capture the metallic and/or magnetic particles present in the material when the material passes therethrough. The second flow path also includes an array of magnets that operate in a manner that is similar to the first array of magnets.

In operation, the flap of the diverter valve adjacent the inlet may be placed in a first position so that the material is directed through the first flow path. As the material passes through the first flow path, the array of magnets remove the metallic particles present in the material. After a period of exposure to the flow of the material, the magnets become covered with the attracted metallic particles, thereby requiring the magnets to be cleaned. Preferably, the machine includes a retraction and wiping mechanism that enable the magnets to be wiped clean of the metallic particles. As the magnets are wiped clean, the magnetic particles fall into a trap located adjacent the lower end of the machine. As the magnetic array in the first flow path is being cleaned, the flap of the diverter valve is in the second position for directing the material through the second flow path. In the second position, the material is directed through the second flow path until the array of magnets are at least partially covered by the metallic particles. The second array of magnets may then be cleaned in a similar manner as discussed above with respect to the first array of magnets.

The flap of the diverter valve is desirably moved back and forth between the at least two positions for alternating the flow direction of the material. Preferably, when one of the flow paths is being utilized for removing the metallic particles from the material, the magnets in the other flow path are being cleaned. The removing metallic particles and cleaning steps may be continuously alternated between the first and second flow paths. The frequency for alternating between the first and second switch positions is preferably dependent upon the concentration of metallic particles present in the material.

Although the present invention is not limited by any particular theory of operation, it is believed that providing two or more distinct paths for removing metallic particles from the solid material will enable the machine to operate continuously. Conventional metallic particle separator machines must be shut down to clean the magnets, which prevents continuous operation and reduces the volume of material from which metallic and/or magnetic particles may be separated.

In one preferred embodiment of the present invention, a metallic particle separating machine includes an inlet for receiving a material having metallic and/or magnetic particles mixed therein, and an outlet for discharging the material after the metallic particles have been separated therefrom. The separating machine desirably includes first and second flow paths extending between the inlet and the outlet, a first magnetic element positionable in the first flow path, and a second magnetic element positionable in the second flow path. The separating machine also preferably includes a control system having a first state for directing the material through the first flow path and a second state for directing the material through the second flow path. The first and second flow paths are preferably separate and distinct from one another so that the material is directed through only one of the flow paths at any point in time.

The first and second magnetic elements are desirably adapted to magnetically attract the metallic particles present in the material as the material passes between the inlet and the outlet. In certain preferred embodiments, the first magnetic element includes a first array of magnetic bars extendable across the first flow path. The first array of magnetic bars is desirably retractable from the first flow path for cleaning the magnetic bars and/or removing the metallic particles from the magnetic bars. The second magnetic element may include a second array of magnetic bars extendable across the second flow path. The second array of magnetic bars is desirably retractable from the second flow path for cleaning the magnetic bars and removing the metallic particles from the second magnetic bars. In certain preferred embodiments, one or more of the magnetic bars may include a magnetic part and a non-magnetic part.

The separating machine may also include one or more cleaning elements in communication with the first and second arrays of magnetic bars for removing metallic particles from the first and second arrays of magnetic bars. The cleaning element may comprise a wiper, such as a wiper plate or wiper washers, in contact with the first and/or second arrays of magnetic bars. The cleaning element may also include a pressurized fluid, such as compressed air, directed at the outer surfaces of the magnetic bars.

Preferably, the separating machine of the present invention includes a plurality of pneumatic valves that serve to control movable elements in the machine. Generally, a pneumatic valve actuator may be used to adjust a valves position by converting air pressure into linear or rotary motion. For example, in the present invention a pneumatic valve is preferably used to rotate a top flap located adjacent the inlet from a first to a second position, the top flap used for directing material that enters the inlet into either the first or second flow paths. Further, a pneumatic valve may be used to control the movement of magnetic bars in a linear direction, namely out of and back into the first and second flow paths respectively. Further still, pneumatic valves may be used to rotate bottom flaps located adjacent the outlet from a first to a second position.

The separating machine preferably further includes a timer associated with the pneumatic valves. The timer is generally used to set the actuation interval of the valves. After an interval is chosen, and the timer is set, the pneumatic valves will be actuated after each interval has ended. At such a time, the separating machine may change from a first state wherein material is directed through the first flow path to a second state wherein material is directed through the second flow path and vice versa depending upon which state the separating machine is in.

Preferably, an operator sets the timer to a specific interval. The interval indicates the amount of time between actuations of each of the pneumatic valves that control the position of the top flap, the first and second array of magnetic bars, and the bottom left and bottom right flap. The interval is generally determined by the capacity of magnetic particles that the magnetic bars located in a flow path can contain at any one time.

In some instances, the amount of metallic and/or magnetic particles in a certain material that will run through a flow path during a given time period may be calculated by an operator. If the amount of magnetic particles in a certain material is known or generally known, then the amount of magnetic particles that will be contained on a magnetic bar or array of magnetic bars in a flow path may be approximated for a certain amount of material directed through a flow path for a given time period. For example, the operator may calculate that the first array of magnetic bars may contain X amount of magnetic particles after Y amount of material enters the first flow path for Z amount of time. Therefore, an operator may set the timer of the separating machine to a specific interval such that the optimum amount of material may pass through the system while making sure that the magnetic bars are capable of performing their separating function.

In one embodiment of the present invention, a material having a known amount of magnetized particles may be sent through the inlet and received by the first flow path when the top flap is in the first position. At this time, the first array of magnetic bars are in the first flow path collecting magnetized particles as material flows through the flow path. Also preferably at this time, the bottom left flap is in the first position wherein material passing through the first array of magnetic bars may continue along the first flow path and through to the outlet.

The separating machine preferably includes a timer that may be set to actuate pneumatic valves in the system at set intervals. Preferably, at the end of an interval a pneumatic valve is actuated causing the top flap extending from the pneumatic valve to rotate from the first position to the second position. At this time, the pneumatic valves controlling the first array of magnetic bars and the bottom left flap for the first magnetic collection assembly may also be actuated. Preferably, the pneumatic valve controlling the first array of magnetic bars will cause the bars to retract from the first flow path in order to begin the cleaning process of the bars. Preferably, the pneumatic valve controlling the bottom left flap for the first magnetic collection assembly will cause the flap to rotate into the second position wherein the magnetic particles falling from the magnetic bars are directed to enter a metallic particle collection drawer.

Also preferably at this time, the second array of magnetic bars are in a first position located in the second flow path wherein material entering the inlet is now being received by the second flow path. Also preferably at this time, the bottom right flap is in the first position wherein material passing through the second array of magnetic bars may continue along the second flow path and through to the outlet.

When the current interval has ended, the five pneumatic valves controlling the top flap, the first and second array of magnetic bars, and the bottom left and right flap are all preferably actuated. At this time, the pneumatic valve controlling the top flap will preferably be actuated causing the top flap to rotate from the second position back to the first position. At this time, the pneumatic valves controlling the second array of magnetic bars and the bottom right flap for the second magnetic collection assembly may also be actuated. Preferably, the pneumatic valve controlling the second array of magnetic bars will cause the bars to retract from the second flow path in order to begin the cleaning process of the bars. Preferably, the pneumatic valve controlling the bottom right flap for the second magnetic collection assembly will cause the flap to rotate into the second position wherein the magnetic particles falling from the magnetic bars are directed to enter a metallic particle collection drawer.

Also preferably at this time, the pneumatic valve controlling the first array of magnetic bars will cause the magnetic bars to advance back into a first position located in the first flow path wherein the magnetic bars may collect magnetized particles as material flows through the flow path. Also preferably at this time, the bottom left flap is in the first position wherein material passing through the first array of magnetic bars may continue along the first flow path and through to the outlet.

When the current interval has ended, the above process may repeat itself continuously as long as the separating machine is running.

In an alternative embodiment, the control system preferably includes a diverter valve that is movable to a first position for directing the material through the first flow path and a second position for directing the material through the second flow path. The control system desirably has a sensor for sensing a concentration of the metallic particles in the material. The control system also desirably includes a microprocessor in communication with the sensor and the diverter valve. The microprocessor may generate signals for moving the diverter valve between the first and second positions in response to the sensed concentration of the metallic particles present in the material. The microprocessor is preferably adapted to analyze the concentration of the metallic particles present in the material and to adjust the switching frequency of the diverter valve in response to the concentration of the metallic particles present in the material.

In another preferred embodiment of the present invention, a metallic or magnetic particle separating machine includes an inlet for receiving a material having metallic particles mixed therein, an outlet for discharging the material after the metallic particles have been separated therefrom, and at least two flow paths extending between the inlet and the outlet. The separating machine desirably includes at least one magnetic element positionable in each of the flow paths for attracting the metallic particles present in the material, and a control system including a diverter valve for selectively directing the material through each of the flow paths. Each flow path is preferably separate and distinct from one another so that the material is directed through only one of the flow paths at any point in time.

The control system desirably includes a diverter valve that is movable to at least a first position for directing the material through a first flow path and a second position for directing the material through a second flow path. The control system may include a sensor for sensing a concentration of the metallic particles in the material, and a microprocessor in communication with the sensor and the diverter valve, whereby the microprocessor is adapted to analyze the concentration of the metallic particles present in the material and to adjust the switching frequency of the diverter valve in response to the concentration of the metallic particles present in the material.

In still another preferred embodiment of the present invention, a continuously operating metallic particle separating machine includes an inlet for receiving a material having metallic particles mixed therein, an outlet for discharging the material after the metallic particles have been separated therefrom, a first flow path extending between the inlet and the outlet, a first magnetic element positionable in the first flow path, a second flow path extending between the inlet and the outlet, a second magnetic element positionable in the second flow path, and a control system including a diverter valve switchable between a first position for directing the material through the first flow path and a second position for directing the material through the second flow path, whereby a switching frequency of the diverter valve is responsive to the concentration of metallic particles in the material.

These and other preferred embodiments of the present invention will be described in more detail below.

DETAILED DESCRIPTION

Figure 1A:
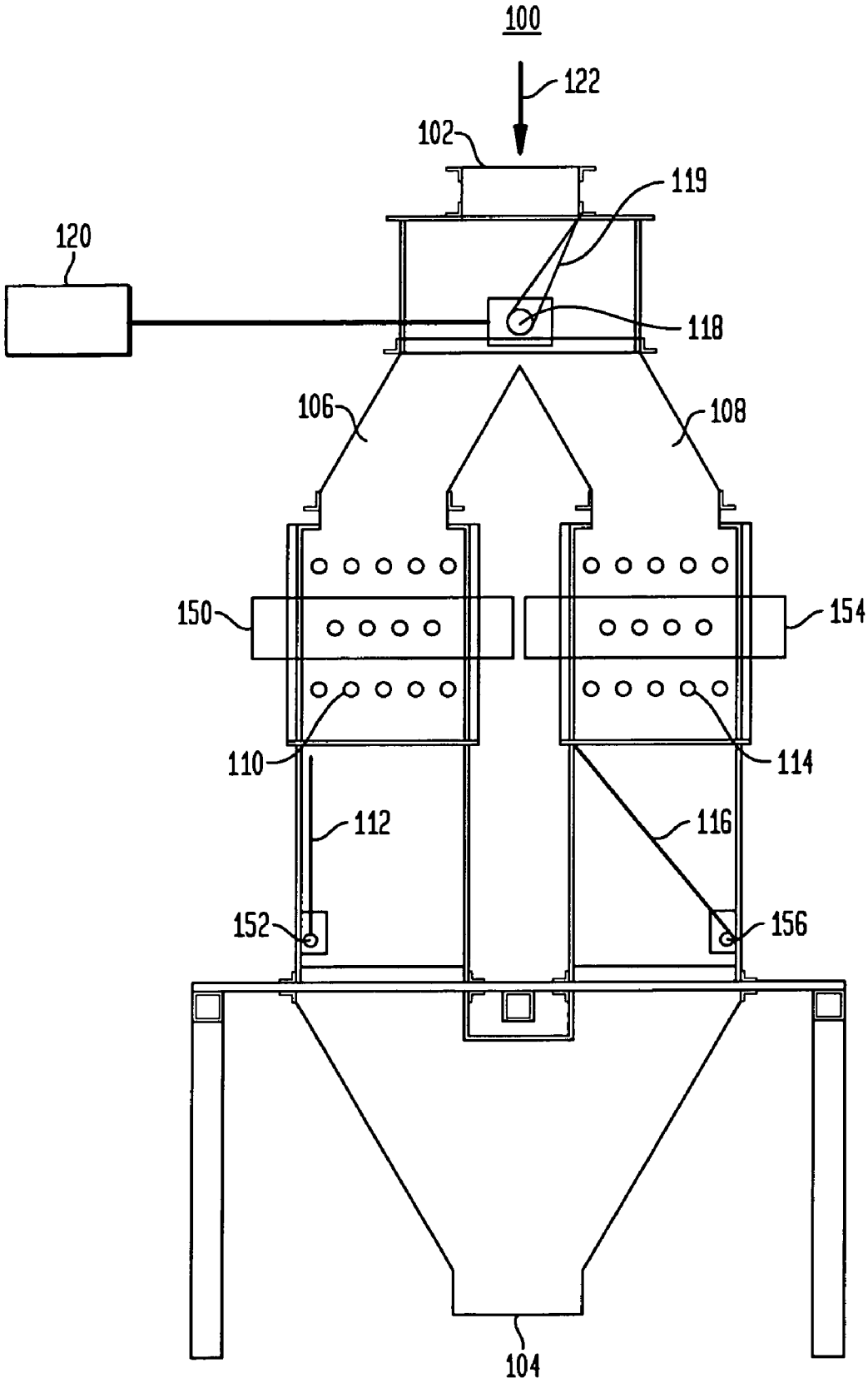
FIG. 1A shows a front cross-sectional view of a metallic particle separating machine including first and second flow paths and a diverter valve in a first position, in accordance with one preferred embodiment of the present invention.
Figure 1B:
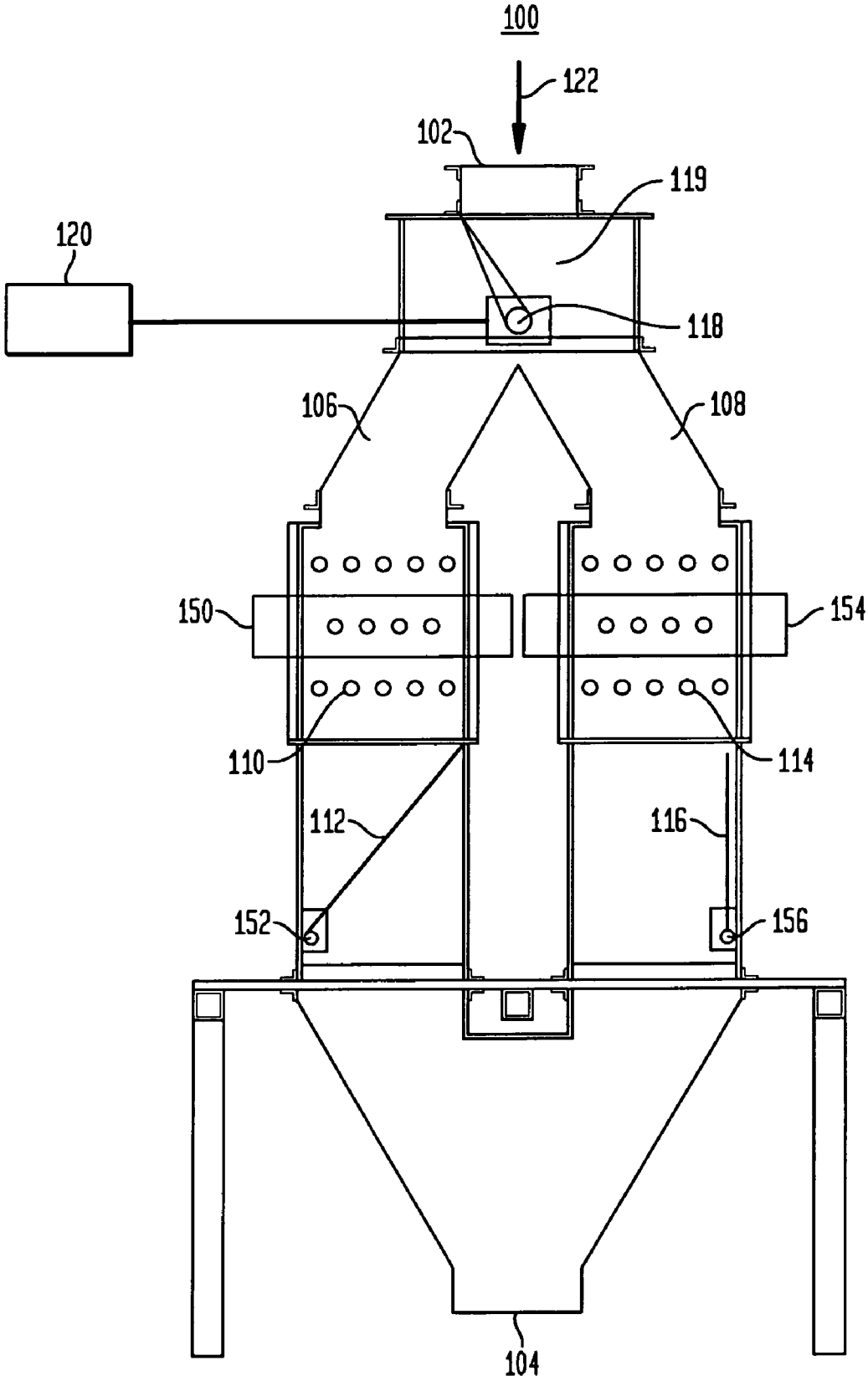
FIG. 1B shows the metallic particle separating machine of FIG. 1A with the diverter valve in a second position.

Referring to FIG. 1A, in certain preferred embodiments of the present invention, a metallic particle separating machine 100 includes an inlet 102, an outlet 104, a first flow path 106 that extends between the inlet 102 and the outlet 104, and a second flow path 108 that also extends between inlet 102 and the outlet 104. The first and second flow paths 106, 108 are separate and distinct from one another. The metallic particle separating machine 100 includes a first array of magnetic bars 110 provided in the first flow path 106, and a first metallic particle collection assembly 112 movable between a substantially vertical position shown in FIG. 1A and a diagonal position (FIG. 1B). The operation of the first metallic particle collection assembly will be provided in more detail below.

The metallic particle separating machine 100 also includes a second array of magnetic bars 114 disposed in the second flow path 108, and a second metallic particle collection assembly 116 movable between the diagonal position shown in FIG. 1A and an upright position shown in FIG. 1B.

Referring to FIGS. 1A and 1B, the metallic particle separating machine 100 includes a diverter valve 118 located adjacent the inlet 102 for directing material that enters the inlet through either the first flow path 106 or the second flow path 108. Preferably, diverter valve 118 is a pneumatic valve. The diverter valve 118 includes a flap 119 that is movable from a first position (FIG. 1A) in which it directs material through the first flow path 106, and a second position (FIG. 1B) in which it directs material through the second flow path 108. The metallic particle separating machine includes a control system 120 for controlling operation of the diverter valve 118, the first array of magnetic bars 110, the second array of magnetic bars 114, the first metallic particle collection assembly, and the second metallic particle collection assembly 116. The control system 120 preferably includes a microprocessor and a program for operating all of the components discussed above. The control system 120 also preferably includes a sensor for detecting the concentration of metallic or magnetic particles present in a material passing through the metallic particle separating machine 100.

The flap 119 of the diverter valve 118 is movable to the second position shown in FIG. 1B for directing material through the second flow path 108. When the flap 119 of the diverter valve 118 is in the second position, the first metallic particle collection assembly 112 is in the extended position, and the second metallic particle collection assembly 116 is in the retracted position.

Preferably, separating machine 100 of the present invention includes a plurality of pneumatic valves 118, 150, 152, 154, 156 that serve to control movable elements in the machine. Generally, a pneumatic valve actuator may be used to adjust a valves position by converting air pressure into linear or rotary motion. For example, pneumatic valve 118 is preferably used to rotate a top flap 119 from a first to a second position, top flap 119 used for directing material that enters the inlet into either first or second flow paths 106, 108. Further, pneumatic valves 150, 154 may be used to control the movement of magnetic bars in a linear direction, namely out of and back into the first and second flow paths respectively. Further still, pneumatic valves 152, 156 may be used to rotate bottom flaps 112, 116 from a first to a second position.

Preferably, separating machine 100 further includes a timer (not shown) associated with pneumatic valves 118, 150, 152, 154, 156. The timer is generally used to set the actuation interval of the valves. After an interval is chosen, and the timer is set, pneumatic valves 118, 150, 152, 154, 156 will be actuated after each interval has ended. At such a time, the separating machine may change from a first state wherein material is directed through first flow path 106 to a second state wherein material is directed through second flow path 108 and vice versa depending upon which state the separating machine is in.

Preferably, an operator sets the timer to a specific interval. The interval indicates the amount of time between actuations of each of pneumatic valves 118, 150, 152, 154, 156 that control the position of top flap 119, first and second array of magnetic bars 110, 114, and left and right bottom flaps 112, 116. The interval is generally determined by the capacity of magnetic particles that magnetic bars 110, 114 located in either flow path 106, 108 can contain at any one time.

In some instances, the amount of metallic and/or magnetic particles in a certain material that will run through a flow path during a given time period may be calculated by an operator. If the amount of magnetic particles in a certain material is known or generally known, then the amount of magnetic particles that will be contained on a magnetic bar or array of magnetic bars in a flow path may be approximated for a certain amount of material directed through a flow path for a given time period. For example, the operator may calculate that the first array of magnetic bars may contain X amount of magnetic particles after Y amount of material enters the first flow path for Z amount of time. If the operator knows how much magnetic particles the array of magnetic bars can contain at any one time, the operator can then set the interval so that the array of magnetic bars change from a separating state to a cleaning state.

In one embodiment of the present invention, a material 122 having a known amount of magnetized particles may be sent through inlet 102 and received by first flow path 106 when top flap 119 is in the first position. At this time, first array of magnetic bars 110 are in first flow path 106 collecting magnetized particles as material 122 flows through flow path 106. Also preferably at this time, bottom left flap 112 is in the first position wherein material 122 passing through first array of magnetic bars 110 may continue along first flow path and 106 through to outlet 104.

The timer may be set to actuate pneumatic valve 118 controlling top flap 119 to rotate top flap 119 from the first position to the second position at the end of the interval. As pneumatic valve 118 controlling top flap 119 is actuated, top flap 119 will rotate from the first position to a second position. At this time, pneumatic valves 150, 152 controlling first array of magnetic bars 110 and bottom left flap 112 for first magnetic collection assembly may also be actuated. Preferably, pneumatic valve 150 controlling first array of magnetic bars 110 will cause the bars to retract from first flow path 106 in order to begin the cleaning process of the bars. Preferably, pneumatic valve 152 controlling bottom left flap 112 for first magnetic collection assembly will cause the flap to rotate into the second position wherein the magnetic particles falling from magnetic bars 110 are directed to enter a metallic particle collection drawer.

Also preferably at this time, second array of magnetic bars 114 are in a first position located in second flow path 108 wherein material 122 entering inlet 102 is now being received by second flow path 108. Also preferably at this time, bottom right flap 116 is in the first position wherein material 122 passing through second array of magnetic bars 114 may continue along second flow path 108 and through to outlet 104.

When the current interval has ended, the five pneumatic valves 118, 150, 152, 154, 156 controlling top flap 119, first and second array of magnetic bars 110, 114, and bottom left and right flaps 112, 116 respectively, are all preferably actuated. Preferably at this time, pneumatic valve 118 controlling top flap 119 will be actuated causing top flap 119 to rotate from the second position back to the first position. At this time, pneumatic valves 154, 156 controlling second array of magnetic bars 114 and bottom right flap 116 for second magnetic collection assembly may also be actuated. Preferably, pneumatic valve 154 controlling second array of magnetic bars 114 will cause the bars to retract from second flow path 108 in order to begin the cleaning process of the bars. Preferably, pneumatic valve 156 controlling bottom right flap 116 for the second magnetic collection assembly will cause the flap to rotate into the second position wherein the magnetic particles falling from the magnetic bars are directed to enter a metallic particle collection drawer 142.

Also preferably at this time, pneumatic valve 150 controlling first array of magnetic bars 110 will cause the magnetic bars to advance back into a first position located in first flow path 106 wherein the magnetic bars may collect magnetized particles as material 122 flows through the flow path. Also preferably at this time, bottom left flap 112 is in the first position wherein material 122 passing through first array of magnetic bars 110 may continue along first flow path 106 and through to outlet 104.

When the current interval has ended, the above process may repeat itself continuously as long as the separating machine is running.

Figure 2:
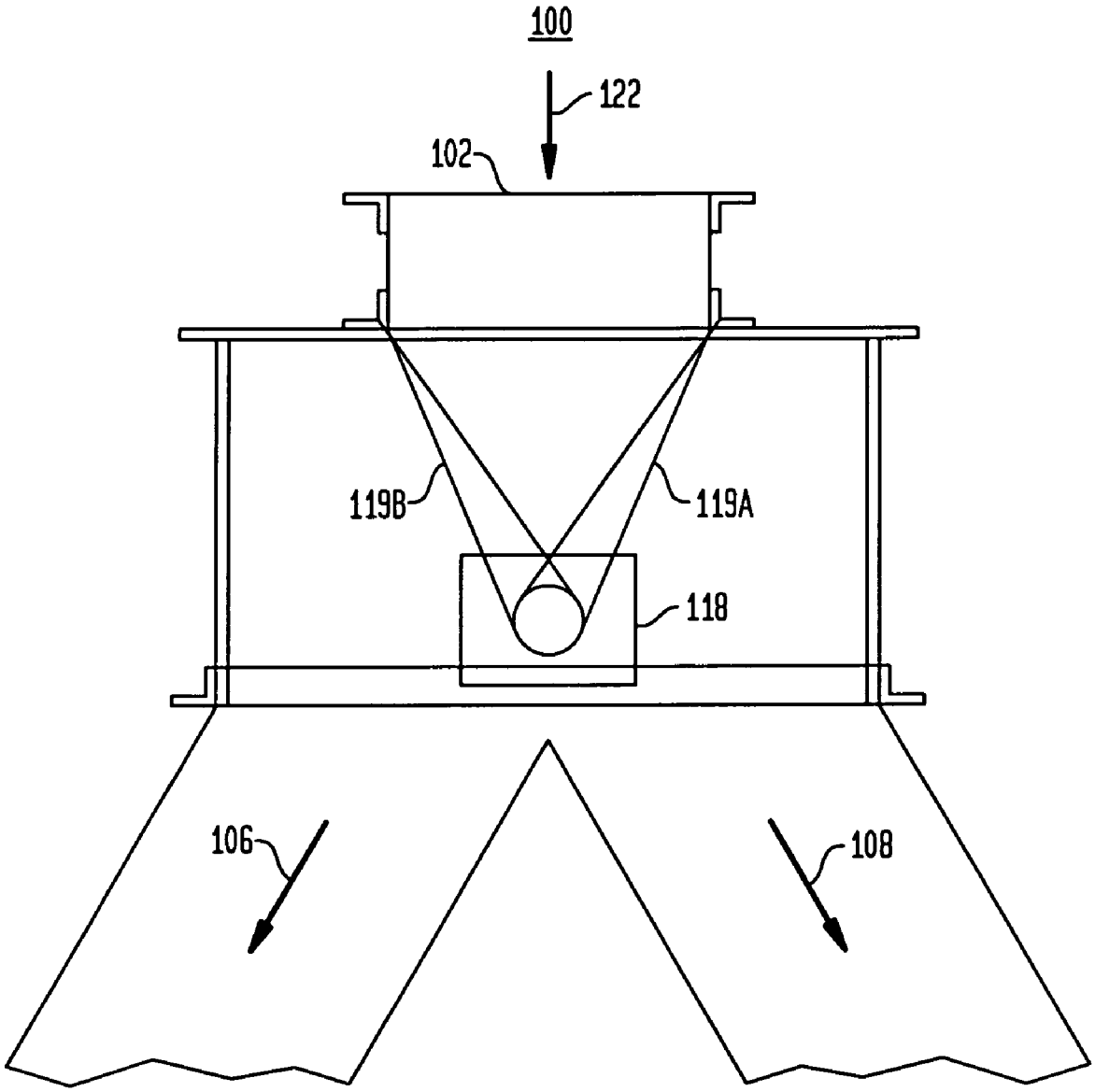
FIG. 2 shows a front cross-sectional view of an upper end of the metallic particle separating machine shown in FIG. 1A.

FIG. 2 shows the upper end of the metallic particle separating machine 100 shown in FIGS. 1A and 1B. As shown in FIG. 2, the metallic particle separating machine 100 includes the inlet 102 that is adapted to receive a material, such as dry bulk material such as chemicals, spices, pharmaceutical ingredients, food ingredients, etc. Although the present invention is not limited by any particular theory of operation, it is believed that the metallic particle separating machine disclosed herein may be used for removing metallic particles from dry material goods such as spices. Typically, such dry material goods have metallic or magnetic particles mixed therein that must be removed before the dry material goods may be further processed to make spices, pharmaceutical products, chemicals or food products.

Referring to FIG. 2, the actuator valve 118 includes a flap 119 that is movable between the first position 119A and the second position 119B. When the actuator valve 118 moves the flap to the first position designated by reference number 119A, the material 122 is directed through the first flow path 106. When the actuator valve 118 moves the flap to the second position designated by reference number 119B, the material 122 is directed through the second flow path 108.

Figure 3A:
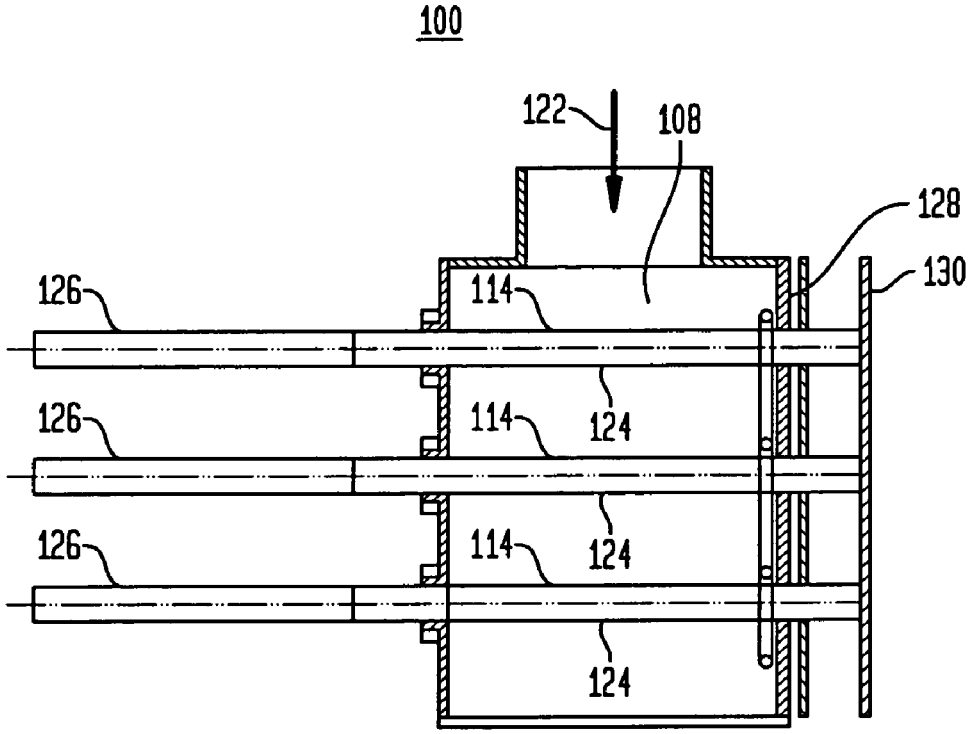
FIG. 3A shows a fragmentary cross-sectional view of the metallic particle separating machine shown in FIG. 1A, including an array of magnetic bars in a first position.
Figure 3B:
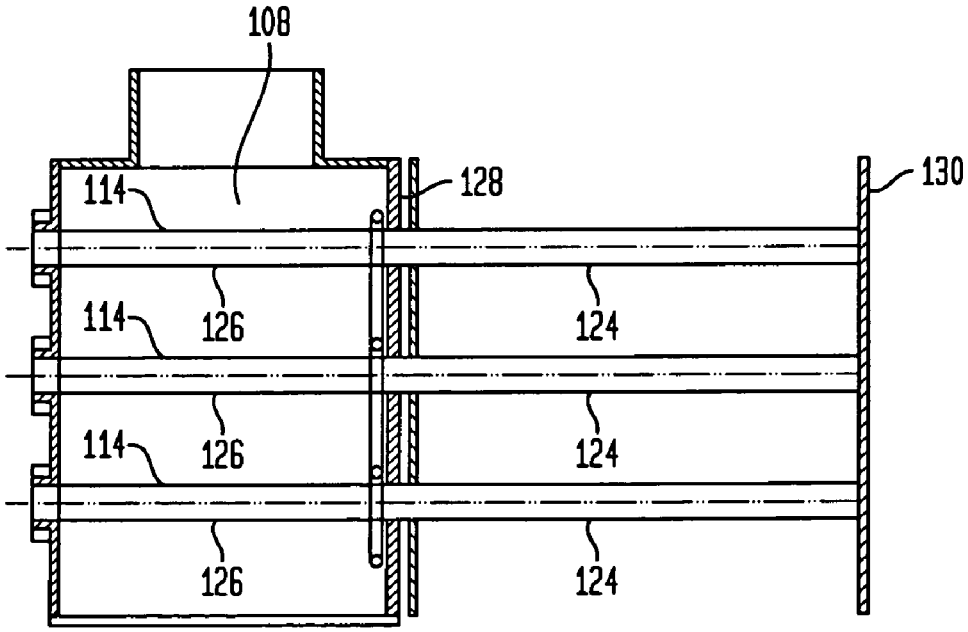
FIG. 3B shows a fragmentary cross-sectional view of the metallic particle separating machine shown in FIG. 1A, with the array of magnetic bars in a second position.

FIGS. 3A and 3B show a fragmentary, cross-sectional view of the metallic particle separating machine 100 shown in FIGS. 1A, 1B and 2. In particular, FIGS. 3A and 3B show the second array of magnetic bars 114 that are provided in the second flow path 108 of the machine. Each of the magnetic bars 114 has a magnetic section 124 and a non-magnetic section 126. In other preferred embodiments, the entire length of the bar 114 may be magnetic. In still other embodiments, the bars 114 may be activated into a magnetic state, and then deactivated so that the bars 114 are no longer magnetic.

In preferred embodiments, the array of magnetic bars 114 are movable between the inserted or advanced position shown in FIG. 3A and the retracted position shown in FIG. 3B. When the array of magnetic bars 114 are in the advanced position shown in FIG. 3A, the magnetic portions 124 of the bars 114 are aligned with the second flow paths 108. As the material 122 having the metallic particles mixed therein passes over the bars 114, the magnetic portions 124 of the bars attract the metallic particles present in the material. As is well known to those skilled in the art, after a period of time, the outer surfaces of the magnetic portions 124 of the bars 114 will become covered by metallic particles. As a result, the bars must be cleaned of the metallic particles so that the bars can effectively remove the metallic particles present in the material. At this stage, the array of magnetic bars 114 are moved to the retracted position shown in FIG. 3B so that the non-magnetic portions 126 of the magnetic bars 114 are aligned with the second flow path 108.

Referring to FIGS. 3A and 3B, the metallic particle separating machine 100 includes a wiping element 128, such as wiping washers, which engage the outer surfaces of the bars 114. The wiping element preferably scrapes the outer surfaces of the bars 114 as the bars are moved between the advanced position shown in FIG. 3A and the retracted position shown in FIG. 3B.

In certain preferred embodiments, the outer end of each of the bars 114 is attached to a plate 130 that provides for simultaneously movement of the bars 114 between the advanced position shown in FIG. 3A and the retracted position shown in FIG. 3B.

Figure 4:
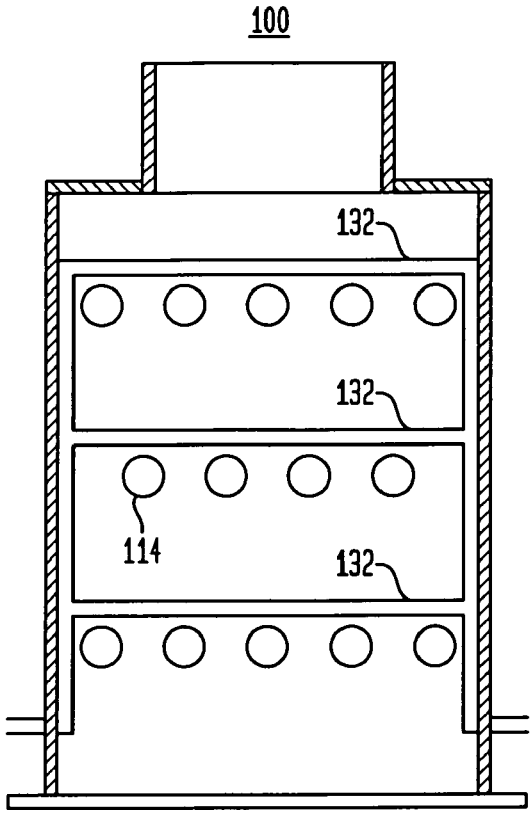
FIG. 4 shows a metallic particle separating machine, in accordance with another preferred embodiment of the present invention.

Referring to FIG. 4, in certain preferred embodiments of the present invention, the metallic particle separating machine 100 includes compressed air lines 132 that direct high pressure air at the outer surfaces of the magnetic bars 114. In one preferred embodiment, the compressed air preferably provides a primary means for removing the metallic particles that have been collected on the outer surfaces of the bars 114. In other preferred embodiments, the compressed air may provide a supplemental means for removing the metallic particles from the bars. In this embodiment, the wiping element 128 (FIG. 3A) provides the primary structure for removing the metallic particles from the bars 114 and the compressed air lines 132 (FIG. 4) provide the supplemental means for removing the metallic particles from the bars 114. Thus, the present invention may provide provides a wiping element and/or a high pressure air system that direct high pressure air at an outer surface of the bars for removing metallic particles from the magnetic bars.

Figure 5:
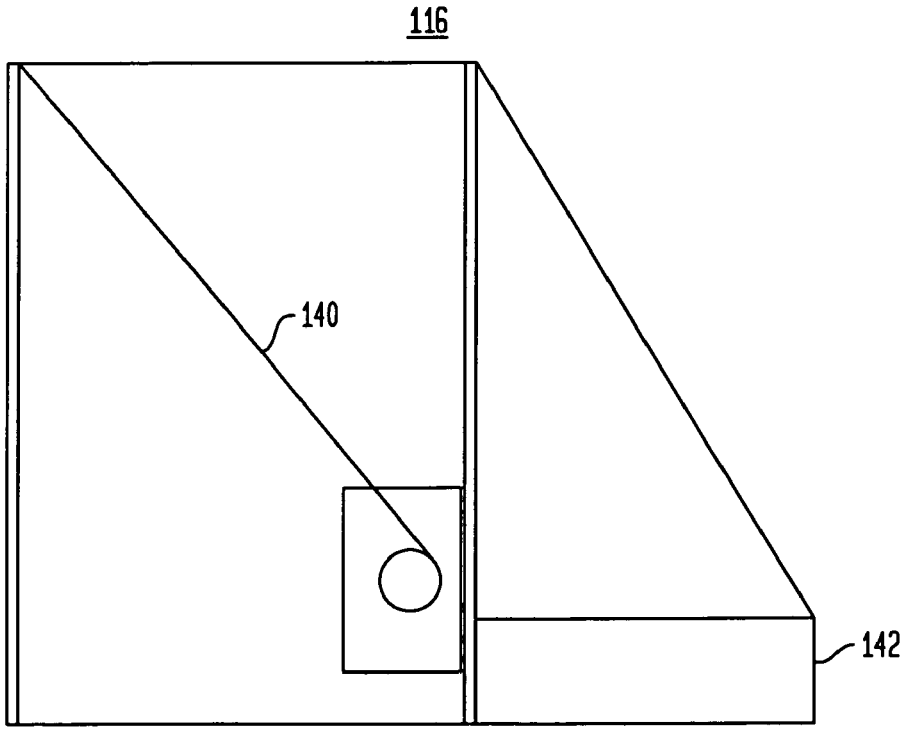
FIG. 5 shows a cross-sectional side view of a metallic particle collection assembly used with the metallic particle separating machine described herein, in accordance with still another preferred embodiment of the present invention.

FIG. 5 shows an expanded view of the second metallic particle collection assembly 116 shown in FIGS. 1A and 1B. The metallic particle collection assembly 116 includes a flap 140 movable between the extended position shown in FIG. 5A and an upright position (not shown). The flap 140, when in the extended position, directs metallic particles into a metallic particle collection drawer 142. The drawer 142 may be periodically emptied so that additional metallic particles may be collected in the metallic particle collection drawer 142.

Operation of the metallic particle separating machine discussed above will now be described in further detail. The metallic particle separating machine is designed to remove metallic particles that may be present in dry or solid materials such as spices, chemicals, pharmaceutical ingredients, and food ingredients such as flour, sugar, wheat and rye. The metallic particle separating machine of the 100 of the present invention is designed to efficiently remove the metallic particles present in the material as the material passes through the machine from the inlet 102 to the outlet 104. The metallic particle separating machine is designed to operate continuously so that it does not need to be shut down in order to clean the magnetic bars disposed in the flow paths.

As shown in FIG. 1A, when the flap 119 of the diverter valve 118 is in the first position, the solid material 122 is directed through the first flow path 106 and onto the first array of magnetic bars 110. As the material passes through the first array of magnetic bars 110, the magnetic bars attract the metallic particles for removing the metallic particles that are present in the solid material 122. When the flap 119 is in the first position, the metallic particle collection assembly 112 is in the upright position so that the filtered material may be discharged from the first flow path 106 and through the outlet 104. As the material 122 is being directed through the first flow path 106, the magnetic bars 114 in the second flow path 108 are being cleaned. The magnetic bars may be cleaned by retracting the bars to the position shown in FIG. 3B and/or by directing high-pressure fluid (e.g. compressed air) at the outer surfaces of the bars 114 to remove any metallic particles remaining on the outer surfaces of the bars 114. The second metallic particle collection assembly 116 is in the extended position so that any metallic particles stripped or removed from the outer surfaces of the bars 114 may be directed into the metallic particle collection drawer 142 (FIG. 5).

The controller 120 (FIGS. 1A and 1B) preferably controls operation of the metallic particle separating machine 100 so that the machine may be operated continuously. The controller 120 desirably includes a sensor that detects or senses the concentration of metallic particles that are present in the material 122. As is well known to those skilled in the art, the magnetic bars must be cleaned more frequently when there is a higher concentration of metallic particles present in the material. Thus, the switching of the flap 119 and the cleaning of the magnetic bars must occur more frequently when the concentration of metallic particles in the material is greater. This is because the magnetic bars quickly become fully covered with metallic particles and must be cleaned more frequently to effectively remove the metallic particles from the solid material. Thus, the sensor and the controller 120 continuously monitor the concentration of the metallic particles and switch the position of the flap 119 depending on the concentration of the metallic particle. The sensor may include an optical sensor that monitors the concentration and/or presence of metallic particles present on the outer surfaces of the magnetic bars. The sensor may also be located outside the separating machine. In other preferred embodiments, any sensor well-known to those skilled in the art for detecting the presence of metallic particles and the concentration of metallic particles in the solid material may be used.

When the first array of magnetic bars are fully covered by metallic particles, the flap 119 is switched to the second flap position shown in FIG. 1B. When the flap 119 is in the second flap position (FIG. 1B), the solid material 122 is directed through the second flow path 108 and onto the second array of magnetic bars 114. The second array of magnetic bars 114 remove the metallic particles present in the material 122 so that the material discharged from the outlet 104 is free of metallic particles. As the solid material 122 is being directed through the second flow path 108, the first array of magnets 110 in the first flow path 106 are being cleaned using the method described above. As the first array of magnets are being cleaned, the metallic particle discharge flap 112 is in the extended position for collecting the metallic particles that are removed from the first magnetic bars 110. At the same time, the second metallic particle discharge flap 116 is in the upright or retracted position so that the solid material 122 (free of metallic particles) may be discharged through the outlet 104.

The controller 120 continuously monitors the concentration of the metallic particles present in the solid material 122. When the concentration of metallic particles is greater, the diverter valve 118 must move between the first and second flap positions more frequently. This is because the magnetic bars 110, 114 more quickly become covered with the metallic particles. When the concentration of metallic particles is lower, the frequency for moving the flap 119 between the two flap positions is reduced.

Although the present invention is not limited by any particular theory of operation, it is believed that providing at least two distinct and separate flow paths for removing metallic particles provides a metallic particle separating machine that may be operated continuously. This is because the material may be at all times directed through at least one flow path having an array of magnetic elements such as magnetic bars. As the array of magnetic bars in the first flow path are collecting the metallic particles, the array of magnetic bars in the second flow path may be cleaned. Once the array of magnetic bars in the second path are cleaned, the second flow path may be the primary path for removing the metallic particle, while the array of magnetic bars in the first flow path are being cleaned. The system preferably switches back and forth so that at all times an array of magnetic bars are available for removing metallic particles from the solid material. The present invention provides a dramatic improvement over prior art separating machines that must be periodically shut down for cleaning the magnets. Thus, the present invention provides an improved system for removing metallic particles from solid material, and the present invention provides a machine that may be operated continuously without requiring a shut-down period for cleaning the magnets.

Although the invention herein has been described with reference to particular embodiments, it is to be understood that these embodiments are merely illustrative of the principles and applications of the present invention. For example, separating machines in other preferred embodiments of the present invention may have three of more flow paths used for separating metallic particles from material, with each flow path having its own magnetic element for removing metallic particles. The present invention may also be used for removing metallic particles from solids, liquids, or gasses, or any combination of solids, liquids, or gases. In still other preferred embodiments, the array of magnetic bars may include outer sheaths or tubes into which metallic bars are inserted. It is therefore to be understood that numerous modifications may be made to the illustrative embodiments and that other arrangements may be devised without departing from the spirit and scope of the present invention as defined by the appended claims.

The invention claimed is:

1. A metallic particle separating machine comprising:

an inlet for receiving a material having metallic particles mixed therein;

an outlet for discharging the material after the metallic particles have been separated therefrom;

first and second flow paths extending between the inlet and the outlet;

a first magnetic element positionable in the first flow path;

a second magnetic element positionable in the second flow path; and a control system having a first state for directing the material through the first flow path and a second state for directing the material through the second flow path, wherein the control system comprises a diverter valve having a flap extending therefrom, the flap movable between a first position for directing the material through the first flow path and a second position for directing the material through the second flow path, and wherein the control system comprises a sensor for sensing a concentration of the metallic particles in the material.

2. The separating machine as claimed in claim 1, wherein the metallic particles comprise magnetic particles.

3. The separating machine as claimed in claim 1, wherein the first and second flow paths are separate and distinct from one another so that the material is directed through only one of the flow paths at any point in time.

4. The separating machine as claimed in claim 1, wherein the first and second magnetic elements are adapted to magnetically attract the metallic particles present in the material as the material passes between the inlet and the outlet.

5. The separating machine as claimed in claim 4, wherein the first magnetic element comprises a first array of magnetic bars extendable across the first flow path.

6. The separating machine as claimed in claim 5, wherein the first array of magnetic bars is retractable from the first flow path for removing the metallic particles from the magnetic bars.

7. The separating machine as claimed in claim 6, further comprising a cleaning element in communication with the first array of magnetic bars for the removing metallic particles from the first array of magnetic bars.

8. The separating machine as claimed in claim 7, wherein the cleaning element comprises a wiper in contact with the first array of magnetic bars.

9. The separating machine as claimed in claim 7, wherein the cleaning element comprises a pressurized fluid directed at outer surfaces of the magnetic bars.

10. The separating machine as claimed in claim 5, wherein at least one of the magnetic bars comprises a magnetic part and a non-magnetic part.

11. The separating machine as claimed in claim 1, wherein a timer set at a specific interval controls the control system such that at the end of the specific interval the i control system changes between the first and second states.

12. The separating machine as claimed in claim 1, wherein the control system comprises a microprocessor in communication with the sensor and the diverter valve, and wherein the microprocessor generates signals for moving the diverter valve between the first and second positions in response to the sensed concentration of the metallic particles present in the material.

13. The separating machine as claimed in claim 12, wherein the microprocessor is adapted to analyze the concentration of the metallic particles present in the material and to adjust the switching frequency of the diverter valve in response to the concentration of the metallic particles present in the material.

14. A metallic particle separating machine comprising:

an inlet for receiving a material having metallic particles mixed therein;

an outlet for discharging the material after the metallic particles have been separated therefrom;

at least two flow paths extending between the inlet and the outlet;

at least one magnetic element positionable in each of the at least two flow paths for attracting the metallic particles present in the material;

a control system including a diverter valve for selectively directing the material through each of the at least two flow paths;

a sensor for sensing a concentration of the metallic particles in the material; and a microprocessor in communication with the sensor and the diverter valve, wherein the microprocessor is adapted. to analyze a concentration of the metallic particles present in the material and to adjust the switching frequency of the diverter valve in response to the concentration of the metallic particles present in the material, wherein the control system comprises a diverter valve having a flap extending therefrom, the flap movable between a first position for directing the material through a first flow path and a second position for directing the material through a second flow path.

15. The separating machine as claimed in claim 14, wherein the metallic particles comprise magnetic particles.

16. The separating machine as claimed in claim 14, wherein each of the at least two flow paths is separate and distinct from one another so that the material is directed through only one of the flow paths at any point in time.

17. The separating machine as claimed in claim 14, wherein each the magnetic elements comprises an array of magnetic bars.

18. The separating machine as claimed in claim 17, wherein each of the array of magnetic bars is retractable from one of the flow paths for removing the metallic particles from the magnetic bars.

* * * * *